United States Patent [19]

Marion

[11] Patent Number: 5,025,728

[45] Date of Patent: Jun. 25, 1991

[54] SELECTIVE POINT DETONATION/DELAY EXPLOSIVE TRAIN DEVICE

[75] Inventor: Richard Marion, Laurel, Md.

[73] Assignee: The United States of America as represented by the Secretary of the Navy, Washington, D.C.

[21] Appl. No.: 465,972

[22] Filed: Feb. 14, 1983

[51] Int. Cl.[5] ..... F42C 9/14

[52] U.S. Cl. ..... 102/271; 102/266

[58] Field of Search ..... 102/266, 268, 270, 271, 102/265

[56] References Cited

U.S. PATENT DOCUMENTS

| | | | |
|---|---|---|---|
| 1,863,888 | 6/1932 | Varaud | 102/271 |
| 2,129,692 | 9/1938 | Hottinger | 102/271 |
| 2,173,143 | 9/1939 | Towner | 102/271 |
| 2,483,555 | 10/1949 | Nichols | 102/271 |
| 2,651,993 | 9/1953 | Berzof et al. | 102/232 |
| 2,664,822 | 1/1954 | Hale | 102/270 |
| 2,831,431 | 4/1958 | Stevenson et al. | 102/270 |
| 3,601,059 | 8/1971 | Briggs | 102/271 |
| 3,985,079 | 10/1976 | Post et al. | 102/266 |
| 4,230,042 | 10/1980 | Popovitch | 102/270 |

OTHER PUBLICATIONS

Naval Publication SW030-AA-MMO-010, pp. 4-3-5-4-40.

*Primary Examiner*—Charles T. Jordan

*Attorney, Agent, or Firm*—Kenneth E. Walden

[57] ABSTRACT

A projectile fuze device selectively adjustable to allow either point detonation (PD) or delayed detonation of the explosive charge of a projectile upon impact with the target. In the PD option the selector assembly permits the centrifugal movement of the alignment assembly during projectile flight to align the PD detonator in the fuze explosive train. In the delayed detonation option the delay detonator in the alignment assembly is aligned in the fuze explosive train prior to firing with subsequent centrifugal movement prevented by the selector assembly.

7 Claims, 3 Drawing Sheets

SELECTIVE POINT DETONATION/DELAY EXPLOSIVE TRAIN DEVICE

BACKGROUND OF THE INVENTION

This invention relates generally to projectile fuzes and more particularly to a device for selectively determining whether, upon projectile impact, detonation of the projectile explosive occurs instantaneously, i.e., point detonation (PD), or is delayed.

A PD/delay device is a combination of two functional assemblies, each embodying a number of mechanical elements. The selector assembly, through its mechanical elements, controls, either directly or indirectly, the functioning of the alignment assembly which contains the PD and delay detonators. Through the selector assembly the operator manually predetermines whether the projectile explosive will be exploded in the PD mode or the delay mode. During projectile flight the mechanical elements of each assembly cooperate among themselves, and interact between assemblies, under the influence of acceleration, centrifugal and mechanical forces, to align either the PD detonator or the delay detonator in the fuze explosive train.

As the number of mechanical elements of a PD/delay device increases, the fabrication cost of the device increases, the fabrication of the fuze body becomes more complex, the integration of the PD/delay device into the fuze body becomes more difficult, and the overall reliability of the fuze decreases. In addition, the greater the number of elements comprising a PD/delay device, the larger is the fuze body cavity required to house the device thus increasing the probability of a fuze malfunction due to the impact deformation forces transmitted through the fuze body, i.e., the hard target penetration capability of the warhead is reduced.

The current fuze for 76 mm, 3 inch/50 and 5 inch/54 naval guns is the MK 407 MOD 1. The PD/delay device for the MOD 1 has divergent-convergent channels that interface with the single axial firing passage. The delay detonator, positioned in one of the divergent-convergent channels, is always aligned in the fuze explosive train. The PD detonator, positioned in the other divergent-convergent channel, is disposed in a rotatable cylinder and is rotatable into or out of alignment with the fuze explosive train by means of a selector switch. Therefore the reaction energy generated by projectile impact always ignites the delay detonator. When the PD option is selected, the PD detonator is rotated into alignment in the fuze explosive train and is ignited by the reaction energy of projectile impact; since the reaction time of the PD detonator is nearly instantaneous the PD detonator reaction energy ignites the next relay element in the fuze explosive train rather than the reaction energy of the delay detonator. A major limitation of the MK 407 MOD 1 PD/delay device is that the exothermic reaction energy generated by projectile impact diverges as it enters the PD/delay device to transverse the divergent-convergent channels; this attenuation of the reaction energy increases the probability of misfire due to lack of sufficient energy to ignite the detonators in the PD/delay device. This device also requires exotic manufacturing techniques to fabricate the divergent-convergent channels which increases the cost and difficulty of manufacturing the fuze. The integration of the PD/delay device in the fuze body requires a larger internal cavity which decreases the hard target penetration capability of the warhead.

The selector assembly of U.S. Pat. No. 2,651,993 to Berzaf et al. directly controls the alignment assembly. The alignment assembly has two longitudinal grooves, of different lengths, connected by an arcuate groove. The pin of the selector assembly is initially disposed in the arcuate groove and may be rotated to either longitudinal groove depending upon which detonation option is selected. With the pin in the selected longitudinal groove the alignment assembly can translate under the action of a spring-bias force to align the selected detonator in the fuze explosive train. Three spring-biased safety mechanisms, two of which function under the influence of the setback force generated when the projectile is fired and one of which functions under the influence of the centrifugal force generated by the spin of the projectile during its free-flight trajectory, interact with the alignment assembly to preclude its translation prior to projectile firing.

In the PD/delay device described in U.S. Pat. No. 2,129,692 to E. J. Hottinger the selector assembly controls the functioning of the alignment assembly both directly and indirectly. The segmented selector assembly directly controls the alignment assembly by means of a finger disposed within recessed grooves in the alignment assembly. A spring-bias torsion force rotates the alignment assembly, the alignment of the preselected detonator in the fuze explosive train determined by the arc length of the groove in which the finger is disposed. Indirect control of the alignment assembly is exerted through a group of spring-biased elements, one of the control elements functioning under setback force to retract the firing pin from a recess in the alignment assembly, freeing it to rotate to align the selected detonator in the fuze explosive train.

In U.S. Pat. No. 1,863,888 to A. Varaud the alignment assembly is stationary. In lieu of a PD detonator there is an obturated firing passage connecting the impact primer with the explosive detonator. The delay charge is parallel to the firing passage and interconnected thereto by a perpendicular passage. The primer reaction energy, therefore, must be transmitted through two ninety degree turns to ignite the delay charge. Reaction energy is attenuated when it is transmitted through passages which are not approximately straight; the delay passage configuration of the Varaud fuze, therefore, decreases the probability that the primer reaction energy will be sufficient to ignite the delay charge. The selector assembly indirectly controls the alignment assembly by controlling the retraction of a spring-biased plunger from a centrifugal bolt which obturates the firing passage. Centrifugal force radially displaces the spring-biased centrifugal bolt, thereby withdrawing the obturating member from the firing passage so that the reaction energy of the primer travels in a straight line to the explosive detonator.

SUMMARY OF THE INVENTION

The present invention surmounts the disadvantages and limitations of the prior art by providing in a PD/delay explosive train device a selector assembly having a rotatable control cylinder peripherally engaging the alignment assembly. The alignment assembly is a spring-biased body having disposed therein the PD and delay detonators. In the delayed detonation option the delay detonator is aligned in the fuze explosive train, with centrifugal displacement of the body precluded by the control cylinder of the selector assembly engaging a guide pin affixed to the body. In the PD option centrifugal force causes the radial movement of the body against the spring-bias force to align the PD detonator in the fuze explosive train. A channel cutout in the control cylinder receives the guide pin during the centrifugal displacement of the body.

It is therefore a primary object of this invention to provide a selector assembly which directly controls the alignment assembly by physically engaging the alignment assembly to control its centrifugal displacement.

Another object of this invention is to reduce the number of mechanical elements comprising the PD/delay explosive train device to enhance reliability and to minimize fabrication costs.

A further object of this invention is to simplify the fabrication of the fuze body by reducing the structural complexity of the fuze body cavity which also will yield significantly improved hard target penetration.

Yet another object of this invention is to minimize the number of forces required for the functioning of the PD/delay explosive train device.

Still a further object of this invention is to simplify the integration of the PD/delay explosive train device within the fuze body cavity.

BRIEF DESCRIPTION OF THE DRAWINGS

Other objects, advantages and novel features of the invention will become apparent from the following detailed description of the invention when considered in conjunction with the accompanying drawings wherein.

PREFERRED EMBODIMENT OF THE INVENTION

Figure 1:
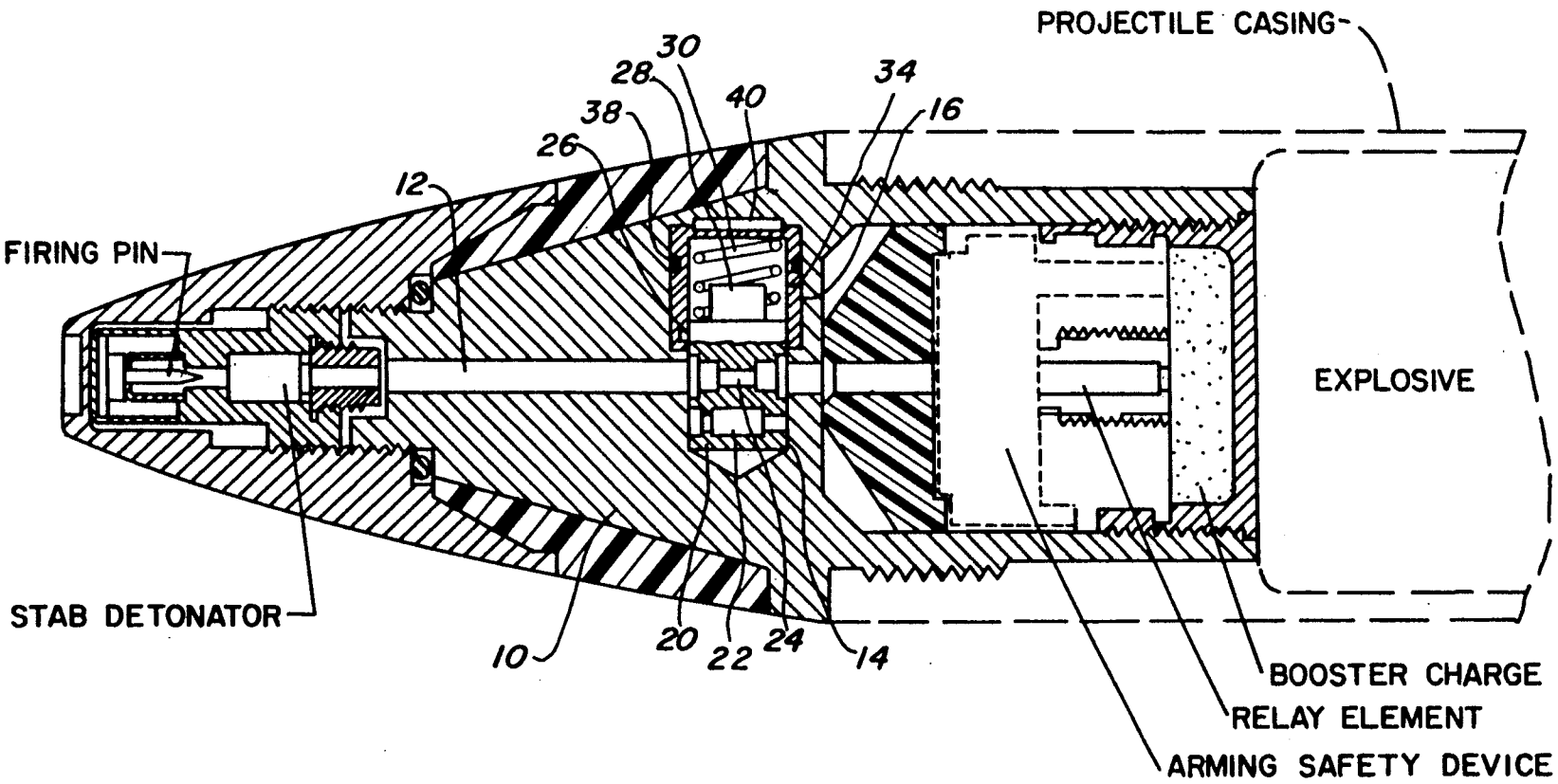
FIG. 1 illustrates a longitudinal cross-sectional view of a projectile fuze body illustrating an embodiment of this invention.

Referring now to the drawings wherein like reference characters designate identical or corresponding parts throughout the several views, FIG. 1 depicts the general configuration of a projectile fuze body 10. A fuze explosive train generally consists of a firing pin, a stab detonator, the PD/delay device, an arming safety device, relay elements, and a booster charge. The PD/delay explosive train device described herein can be utilized in any ordnance fuze, such as bombs, torpedos, projectiles, etc., where the delivery vehicle is spun prior to impacting the target. The single axial firing passage 12 extends throughout the length of the fuze body 10 and serves as a transmission channel for the exothermic chemical reaction energy of the various detonators in the fuze explosive train. Upon projectile impact the firing pin is displaced rearwardly into the stab detonator; the pyrotechnic composition of the stab detonator is such that the frictional contact of the firing pin with the stab detonator causes it to detonate. The reaction energy of the stab detonator traverses the single axial firing passage 12 to react with the detonator of the PD/delay device which is aligned in the fuze explosive train; the detonation energy from the PD/delay detonator is relayed through the arming safety device to ignite the relay elements. The detonation energy of the relay elements is transmitted to ignite the booster charge which in turn causes the projectile explosive to explode. In the fuze body 10 a bore means extends from the surface of the fuze body 10 to intersect the single axial firing passage 12 at approximately right angles. An inner bore 14 of the bore means traverses the firing passage 12 with one end terminating within the fuze body 10, the other end terminating at an outer bore 16, and has a diameter such that the alignment assembly 18 (FIG. 2) can freely translate within bore 14. An anti-rotation/anti-malassembly pin 44 is located within the inner bore 14 to ensure that the alignment assembly 18 cannot be installed improperly nor rotate during projectile handling or firing. Contiguous to, and concentric with, the inner bore 14 is an outer bore 16, which terminates at the surface of the fuze body 10 and has a diameter such that the selector assembly 32 (FIG. 2) is freely rotatable within the outer bore 16.

Figure 2:
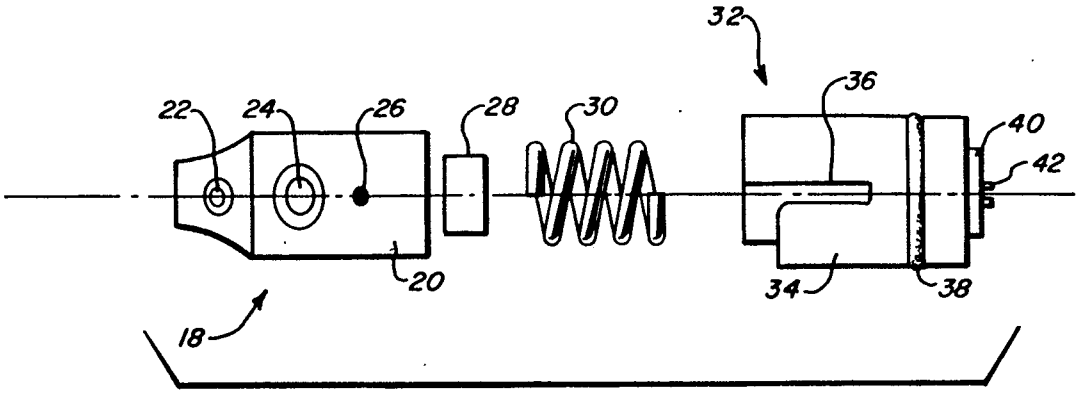
FIG. 2 is an exploded axial view of the alignment assembly and the selector assembly.

FIG. 2 depicts an exploded view of the alignment assembly 18 in cooperation with the selector assembly 32. The body 20 of the alignment assembly 18 is slidably disposed within the inner bore 14. Disposed within the body 20 are the PD detonator 22 and the delay detonator 24, the detonators being orientated such that the axes of the detonators are parallel to the single axial firing passage 12. The configurations and pyrotechnic compositions of the detonators 22, 24 are well known in the art; the pyrotechnic compositions of detonators 22, 24 are selected such that the PD detonator 22 has a near-instantaneous reaction time while the delay detonator 24 has a reaction time of about 8 ms. When the body 20 abuts the anti-rotation/anti-malassembly pin 44 the axis of the delay detonator 24 is aligned with the single axial firing passage 12. In this position the PD detonator 22 is positioned between the delay detonator 24 and the termination of the inner bore 14. A guide pin 26 is affixed to the body 20, parallel to the single axial firing passage 12, at such a position that it is within the outer bore 16 and can engage the selector assembly 32 (FIG. 2). The body 20 is machined at the end abutting the termination of the inner bore 14; one machined segment of the body 20 engages the anti-rotation/anti-malassembly pin 44, with a second segment symmetrically machined to reduce the weight of the body 20 and to ensure that the center-of-gravity of the body 20 lies along the centerline of the body 20. An off-set body 28 is affixed to the end of the body 20 distal from the machined end; the mass of the off-set body 28 is such that the center-of-gravity of the body 20 lies off the centerline of the single axial firing passage 12 towards the selector assembly 32 so that the centrifugal force generated during the projectile's flight tends to displace the body 20 radially outward. A bias spring 30 is attached to the body 20 at the same end as the off-set body 28. The bias spring 30 is of such dimension that it will compress about the off-set body 28. The bias spring 30 permits an operator to reset the fuze to the delayed detonation option if the PD option had been selected previously by preventing the movement of the body 20 in the inner bore 14 until the body 20 is subjected to the centrifugal force generated during the projectile's free flight.

Figure 3:
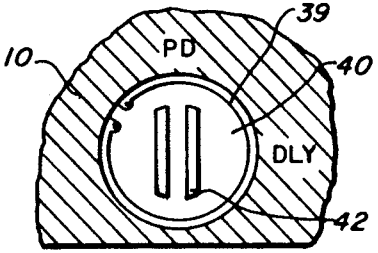
FIG. 3 is a plan view of the selector switch.

The selector assembly 32, depicted in FIG. 2, is disposed within the outer bore 16 and consists of a control cylinder 34 and a selector switch 40. The control cylinder 34 is a thin-walled cylinder having an open end which peripherally engages the body 20. The inside diameter of the control cylinder 34 is such that the cylinder can peripherally engage the body 20 and the outside diameter of the control cylinder 34 is such that it is freely rotatable within the outer bore 16. The selector switch 40 is joined to the control cylinder 34 distal to the body 20; the face of the selector switch 40 is located at the surface of the fuze body 10. On the external face of the selector switch 40 is a setting slot 42 which is manually manipulated by an operator using a standard screw driver or even a coin to select either the PD or delayed detonation option prior to loading and firing the projectile. The detonation option positions are marked on the external surface of the fuze body 10. A retaining ring 39 secures the PD/delay device within the fuze body 10 and prevents any radial displacement of the selector assembly 32 (FIG. 3). An O-ring seal 38 in a circumferential groove in the control cylinder 34 ensures the physical integrity of the PD/delay device from environmental conditions. The open end of the control cylinder 34 has two machined cutouts which engage the guide pin 26 of the alignment assembly 18. The shoulder 35 (FIG. 5) engages the guide pin 26 when the delayed detonation option is selected. When the PD option is selected the channel cutout 36 of the control cylinder 34, located 90° radially from the shoulder 35, is aligned with the guide pin 26. The width of the channel cutout 36 is such that the guide pin 26 can freely translate within the cutout; the length of the channel cutout 36 is such that the guide pin 26 does not abut the end of cutout 36 when the axis of the PD detonator 22 is aligned with the centerline of the single axial firing passage 12.

Figure 4:
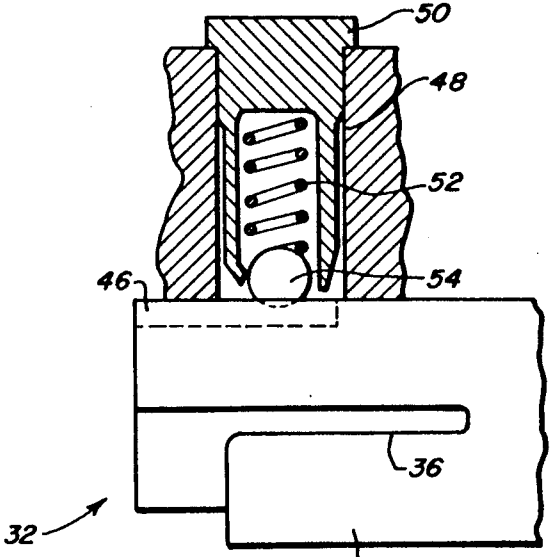
FIG. 4 is an axial view of the detent mechanism, showing its cooperation with the selector assembly.

FIG. 4 depicts the detent mechanism 49 which locks the control cylinder 34 in the selected detonation option. A detent slot 46 is machined in the control cylinder 34 180° radially from the shoulder 35. A detent bore 48 is machined in the fuze body 10 perpendicular to the axis of the control cylinder 34; the axis of the detent bore 48 is located 90° from the axes of detonators 22, 24 and with the delayed detonation option selected the axis of the detent bore 48 intersects the channel cutout 36 of the control cylinder 34. To simplify integration of the detent mechanism 49 within the fuze body 10 the detent bore 48 extends to the outer surface of the fuze body 10 so that the detent mechanism 49 can be externally inserted. The detent mechanism 49 consists of a detent body 50, having a detent bias spring 52 and a detent ball 54, disposed in the detent bore 48. The detent bias spring 52 biases the detent ball 54 against the control cylinder 34. The detent mechanism 49 not only provides a means of locking the selector assembly 32 in the selected detonation option, but also provides feedback to the operator that the selector assembly 32 has been rotated to the selected detonation option by yielding an audible click when the detent ball 54 is biased into either the detent slot 46 or the channel cutout 36.

Figure 5:
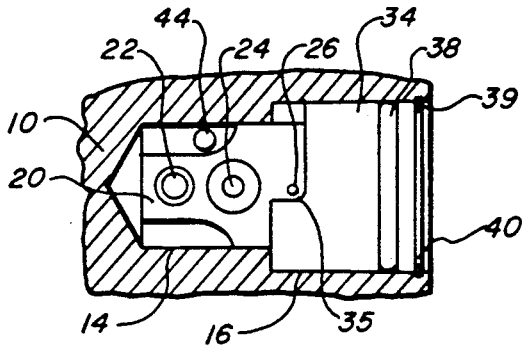
FIG. 5 is an axial, partially-sectioned view of the PD/delay explosive train device in the delayed detonation option configuration.
Figure 6:
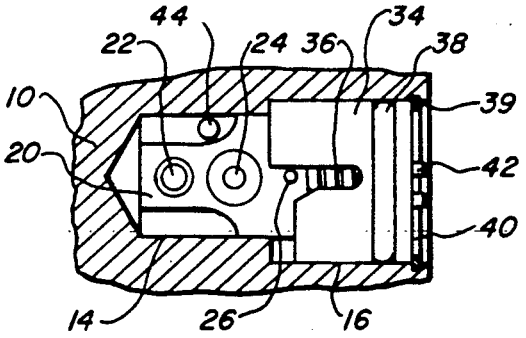
FIG. 6 is an axial, partially-sectioned view, prior to projectile firing, of the PD/delay explosive train device in the PD option configuration.
Figure 7:
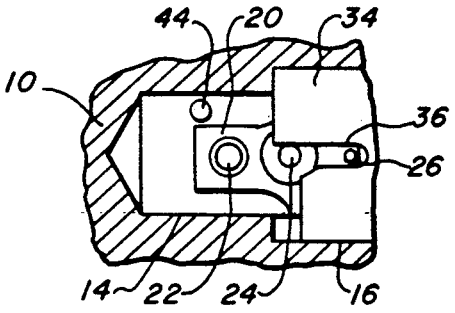
FIG. 7 is an axial, partially-sectioned view, prior to projectile impact with the target, of the PD/delay explosive train device in the PD option configuration.

FIGS. 5, 6 and 7 depict the configurational relationships between the alignment assembly 18 and the selector assembly 32 in the delayed and PD detonation options. The PD/delay device is assembled, mated to the projectile, handled and stored in the delayed detonation option. In this configuration the setting slot 42 of the selector switch 40 points to the delay mark on the fuze body 10, and the control cylinder 34 is aligned so that the shoulder 35 abuts the guide pin 26 of the alignment assembly 18 (FIG. 5). The detent bias spring 52 biases the detent ball 54 into the channel cutout 36 of the control cylinder 34 to prevent rotation of the cylinder. With the delayed detonation option selected, the delay detonator 24 is aligned with the centerline of the single axial firing passage 12. Upon firing, the projectile is spun and centrifugal force tends to radially displace the body 20 towards the outer bore 16; the guide pin 26, however, abuts the shoulder 35 of the control cylinder 34 so that radial movement of the body 20 is prevented. Therefore, upon impact the delay detonator 24 is aligned in the fuze explosive train so that the projectile detonates in the delayed option, i.e., after impacting the target, the projectile continues in its flight path for about 8 ms before it explodes.

The PD option is selected by manually positioning the setting slot 42 of the selector switch 40 to point to the PD mark on the fuze body 10. With the selector switch 40 in this position the control cylinder 34 is rotated so that the channel cutout 36 is aligned with the guide pin 26 of the alignment assembly 18 (FIG. 6). The detent bias spring 52 biases the detent ball 54 into the detent slot 46 of the control cylinder 34 to prevent rotation of the cylinder. Prior to the firing of the projectile, the bias force of the bias spring 30 prevents any radial displacement of the body 20 so that the delay detonator 24 is aligned in the single axial firing passage 12. Firing the projectile imparts a spin to the projectile causing centrifugal force to act upon the body 20. When the centrifugal force is sufficient to overcome the force of the bias spring 30 the body 20 is displaced radially outward, against the spring bias force, into the outer bore 16 until the PD detonator 22 is aligned in the single axial firing passage 12 (FIG. 7). When the PD detonator 22 is aligned in the single axial firing passage 12 the bias spring 30 is compressed around the off-set body 28 against the body 20 such that the off-set body 28 abuts the surface of the selector switch 40 inside the control cylinder 34. As the body 20 is displaced radially outward the guide pin 26 translates in the channel cutout 36 of the control cylinder 34. Upon impact the centrifugal force acting on the body 20 is rapidly attenuated so that the force of the bias spring 30 tends to cause the body 20 to be displaced radially inward thus tending to displace the PD detonator 22 from the single axial firing passage 12. The reaction energy of impact, however, is rapidly transmitted through the single axial firing passage 12 so that the PD detonator 22 is ignited before it can be displaced from the firing passage 12; thus the projectile explodes in the PD option, i.e., instantaneously upon impacting the target.

What is claimed and desired to be secured by Letters Patent of the United States is:

1. A fuze for use on a projectile, comprising:

a fuze body;

said fuze body having a single axial firing passage for communicating energy from its nose to an explosive in the projectile;

said fuze body further having a bore means intersecting said single axial firing passage;

an alignment assembly having disposed therein a PD detonator and a delay detonator;

said alignment assembly slidably disposed in said bore means with said delay detonator normally aligned in said single axial firing passage;

a selector assembly rotatably disposed in said bore means and peripherally engaging said alignment assembly for locking said alignment assembly in its normal position; and said selector assembly being rotatably adjustable to allow centrifugal displacement of said alignment assembly upon spin being imparted to the projectile for aligning said PD detonator in said single axial firing passage.

2. The invention as defined in claim 1 further comprising:

detent means for engaging said selector assembly whereby said selector assembly is locked to preclude inadvertent rotation from its selected position.

3. The invention as defined in claim 1 wherein said bore means comprises:

an inner bore having slidably disposed therein said alignment assembly; and an outer bore concentric to said inner bore and having rotatably disposed therein said selector assembly.

4. The invention as defined in claim 1 wherein said alignment assembly comprises:

a body having disposed therein said PD detonator and said delay detonator;

a guide pin mounted on said body proximal to said selector assembly; and bias means for biasing said body to its normal position.

5. The invention as defined in claim 4 wherein said selector assembly comprises:

a control cylinder peripherally engaging said body;

said control cylinder having a shoulder, a channel cutout located 90° radially from said shoulder, and a detent slot located 180° radially from said shoulder whereby when said alignment assembly is in its normal position said guide pin abuts said shoulder to prevent centrifugal displacement of said alignment assembly and when said selector assembly is rotatably adjusted to allow centrifugal displacement of said alignment assembly for aligning said PD detonator in said single axial firing passage said guide pin is aligned with and may move within said channel cutout; and a selector switch joined to said control cylinder distal said body with said selector switch located on the surface of said fuze body whereby an operator may rotate said selector switch.

6. The invention as defined in claim 5 further comprising:

said selector switch including a segment provided with means configured to allow manual rotation of said selector switch.

7. The invention as defined in claim 6 wherein said detent means comprises:

a detent bore disposed in said fuze body at right angles to said bore means whereby the axis of said detent bore intersects said channel cutout of said control cylinder when it is positioned to lock said alignment assembly in its normal position; and a detent bias spring disposed in said detent bore having a detent ball whereby said detent bias spring biases said detent ball into said said channel cutout when said guide pin abuts said shoulder of said control cylinder to preclude inadvertent rotation of said control cylinder and said bias spring biases said detent ball into said detent slot when said guide pin is aligned with said channel cutout of said control cylinder to preclude inadvertent rotation of said control cylinder.

* * * * *